US005634684A

United States Patent [19]

Kojima et al.

[11] Patent Number: 5,634,684

[45] Date of Patent: Jun. 3, 1997

[54] FOLDABLE CHAIR

[75] Inventors: Kiyoshi Kojima; Takao Sugano, both of Osaka; Nobuyuki Nagai, Nara; Sakuji Ito, Nagano, all of Japan

[73] Assignees: Kokuyo Co., Ltd., Osaka; Takano Co., Ltd., Nagano, both of Japan

[21] Appl. No.: 553,327

[22] PCT Filed: Mar. 20, 1995

[86] PCT No.: PCT/JP95/00520

§ 371 Date: Nov. 16, 1995

§ 102(e) Date: Nov. 16, 1995

[87] PCT Pub. No.: WO96/19932

PCT Pub. Date: Jul. 4, 1996

[30] Foreign Application Priority Data

Dec. 27, 1994 [JP] Japan ..... 6-324622

[51] Int. Cl.[6] ..... A47C 4/00

[52] U.S. Cl. ..... 297/58; 297/452.2; 403/65; 403/71

[58] Field of Search ..... 297/58, 55, 452.18, 297/452.2, 440.24, 16.1; 403/65, 68, 71

[56] References Cited

U.S. PATENT DOCUMENTS

| | | | |
|---|---|---|---|
| 760,451 | 5/1904 | Hayden | 403/71 |
| 950,194 | 2/1910 | Stockwell | 297/452.2 |
| 2,085,475 | 6/1937 | Saives | 297/452.2 X |
| 2,666,478 | 1/1954 | Shwayder | 297/58 |
| 2,757,715 | 8/1956 | Hendrickson | 297/58 |
| 3,203,734 | 8/1965 | Seymer | 297/452.2 X |
| 3,340,828 | 9/1967 | Smith et al. | 297/452.2 X |
| 4,674,793 | 6/1987 | Kettler | 297/440.24 X |
| 5,037,116 | 8/1991 | Desanta | 297/16.1 X |
| 5,050,932 | 9/1991 | Pipon et al. | 297/452.18 X |

FOREIGN PATENT DOCUMENTS

| | | | |
|---|---|---|---|
| 799576 | 6/1936 | France | 403/65 |
| 460941 | 8/1951 | Italy | 297/41 |
| 58-147451 | 10/1983 | Japan . | |
| 6-12682 | 4/1994 | Japan . | |
| 6-269331 | 9/1994 | Japan . | |
| 27579 | of 1906 | United Kingdom | 403/65 |

*Primary Examiner*—Milton Nelson, Jr.
*Attorney, Agent, or Firm*—Banner & Witcoff, Ltd.

[57] ABSTRACT

A foldable chair 100 comprises a front frame 1 made of pipe material with a backrest 12 provided at its top end and having a pair of front legs 11 continuously extending downward from the top end; a rear frame 2 made of pipe material having a pair of rear legs 21 continuously extending downward from its top end with a sliding shaft whose top end is pivotally mounted to the front frame 1 and whose bottom end is slidably inserted into the top end of each of the rear legs 21; and a seat 3 having its lateral sides pivotally supported near its rear side by the rear frame 2 and by the front frame i forwardly of the position supported by the rear frame 2; and is characterized by that the front frame 1 being provided with concaves 4 formed therein above the seat 3 in use by plastically transforming the pipe material, that each sliding shaft is provided at its upper end with a pivot member 51 mounted to the concave 4, and that the front and rear frames 1, 2 are so arranged that the axis of the rear leg 21 is generally aligned with that of the front leg 11 as viewed from the direction in which the foldable chair 100 is folded.

3 Claims, 7 Drawing Sheets

FOLDABLE CHAIR

FIELD OF ART

This invention relates to chairs, and particularly to foldable chairs that can be stacked one upon another.

BACKGROUND ART

Conventional foldable chairs of this type, for example, comprise a front stand made of a metal pipe and formed into a generally U-shape with a backrest provided at the upper open end thereof, a rear stand made of the same metal pipe as the front stand and formed into a generally U-shape, and a seat pivotally mounted to the front and rear stands, and have such a structure that as the front and rear stands are moved to approach each other, the seat is rotated toward the backrest to take an upright posture, thereby to fold the front and rear stands and the seat into a generally flat configuration.

In a foldable chair of the above structure, for example, the outer sides of the front and rear stands are connected through link members so that when the chair is folded, the front and rear stands overlap each other at both sides of the seat as viewed from the front or rear side.

Since the chair has such an arrangement that a link member is pivotally mounted to each leg of the front and rear stands to make a link mechanism of the seat and each link member so that the chair can be folded, not only the number of component parts e.g. the pins to be riveted but also the number of the manufacturing steps increase, with resulting increase in the manufacturing cost.

There is another foldable chair in which slide links are slidably provided at the top end of each of the rear legs and has its top end pivotally mounted to the outer sides of each of the front legs. In this chair, as the top ends of the slide links are connected to the outer sides of the front legs, the rear legs are placed on the outer sides of the front legs. As a result, the seat is supported away from the sides of the rear legs, thereby decreasing the strength to support the seat. In addition, as the rear legs are disposed outside the front legs, a plurality of such chairs arranged closely side by side require a broader space, thereby to decrease the efficiency to utilize space.

In order to solve these problems, a foldable chair has been proposed, in which a joint member is welded to the rear side of each front leg and the top end of a slide link is connected to the joint member. With the slide link using the above joint member, as the joint member is fixed to the rear side of each front leg, the front and rear legs overlap each other as viewed from the front or rear side when the chair is folded.

In the above arrangement, joint members should be provided in addition to the front and rear legs and the seat, thereby to increase the number of component parts. In addition, the welding of the joint members to the front legs must be conducted in a different working step outside the manufacturing line in which cutting and bending of pipe material is conducted. Therefore, the manufacturing line becomes complicated, and even though the line is automated, it is difficult to reduce the number of the manufacturing steps and consequently the manufacturing cost.

DISCLOSURE OF THE INVENTION

This invention has been accomplished in view of the above problems. The object of the invention is to provide a foldable chair which is made of a reduced number of component parts by a reduced number of manufacturing steps, and which has a reduced lateral size to diminish space occupation when arranged side by side in use.

To attain the above-mentioned object the invention has the following structure. The foldable chair in accordance with the invention comprises a front frame made of pipe material with a backrest provided at its top end and having front legs continuously extending downward from the top end, a rear frame made of pipe material having rear legs continuously extending downward from its top end with a sliding shaft whose top end is pivotally mounted to the front frame and whose bottom end is slidably inserted into the top end of each of the rear legs, and a seat having its both sides pivotally supported near its rear side by the rear frame and by the front frame forwardly of the position supported by the rear frame. The chair is characterized by that the front frame is provided with concaves formed therein above the seat in use by plastically transforming the pipe material, that each sliding shaft is provided at its upper end with a pivot member mounted to each concave, and that the front and rear frames are so arranged that the axis of each rear leg is generally aligned with that of the corresponding front leg as viewed from the direction in which the foldable chair is folded.

In accordance with the invention, each concave is formed preferably by transforming a rear half of the pipe material of the front frame into a generally flat configuration, so that the concave occupies on both sides of the pipe of the front frame. The concaves can easily be formed if the front frame is made of metal pipe material.

In accordance with the invention, the following functions and effects are achieved. As the front frame has the concaves and the pivot members of the sliding shafts are joined to the concaves, there is no need to attach an additional member to the front frame in order to pivotally mount the rear frame. In other words, the concaves formed integrally in the front frame by pressing and plastically transforming the front frame make it possible to omit additional members for pivotally mounting the sliding shafts. In addition, as the concaves are formed in the front frame, the axis of each rear leg of the rear frame is so arranged as to be generally aligned with the axis of the corresponding one of the front legs of the front frame as viewed from the direction in which the chair is folded. The rear frame can be pivotally mounted near its rear side to the sides of the seat by planar fixing members and can pivot near the sides of the seat when folded together with the front frame. In accordance with the invention, the distance between each of the frames and the seat is shortened, thereby to increase the strength of the points at which the seat is mounted. In addition, as the rear frame is disposed within the width of the front frame, the chair has a reduced lateral size. Therefore, a plurality of chairs can be arranged side by side in use, with resulting improvement of space efficiency.

As there need be no additional members for pivotally mounting the sliding shaft, the number of component parts can be reduced. In addition, as each concave to which a pivot member which is integrally provided at the top end of each sliding shaft is pivotally mounted is formed by pressing the pipe of the front frame, the concaves can be formed by means of the process which consists of bending or cutting and does not require a process which requires a drastic change in the manufacturing line like welding, thereby to make the manufacturing process easy. Moreover, if the concave is formed so as to occupy both sides of the pipe of the front frame by transforming the rear half of the pipe of the front frame into a generally flat configuration, the process to form the concaves consists of pressing the pipe of the front frame from both sides thereof alone, thereby to make the manufacturing much easier. Likewise, if the front frame is made of metal pipe, the process to form the concaves may be easy.

BEST MODE OF EMBODYING THE INVENTION

An embodiment of the invention will now be described with reference to FIGS. 1 through 5.

Figure 1:
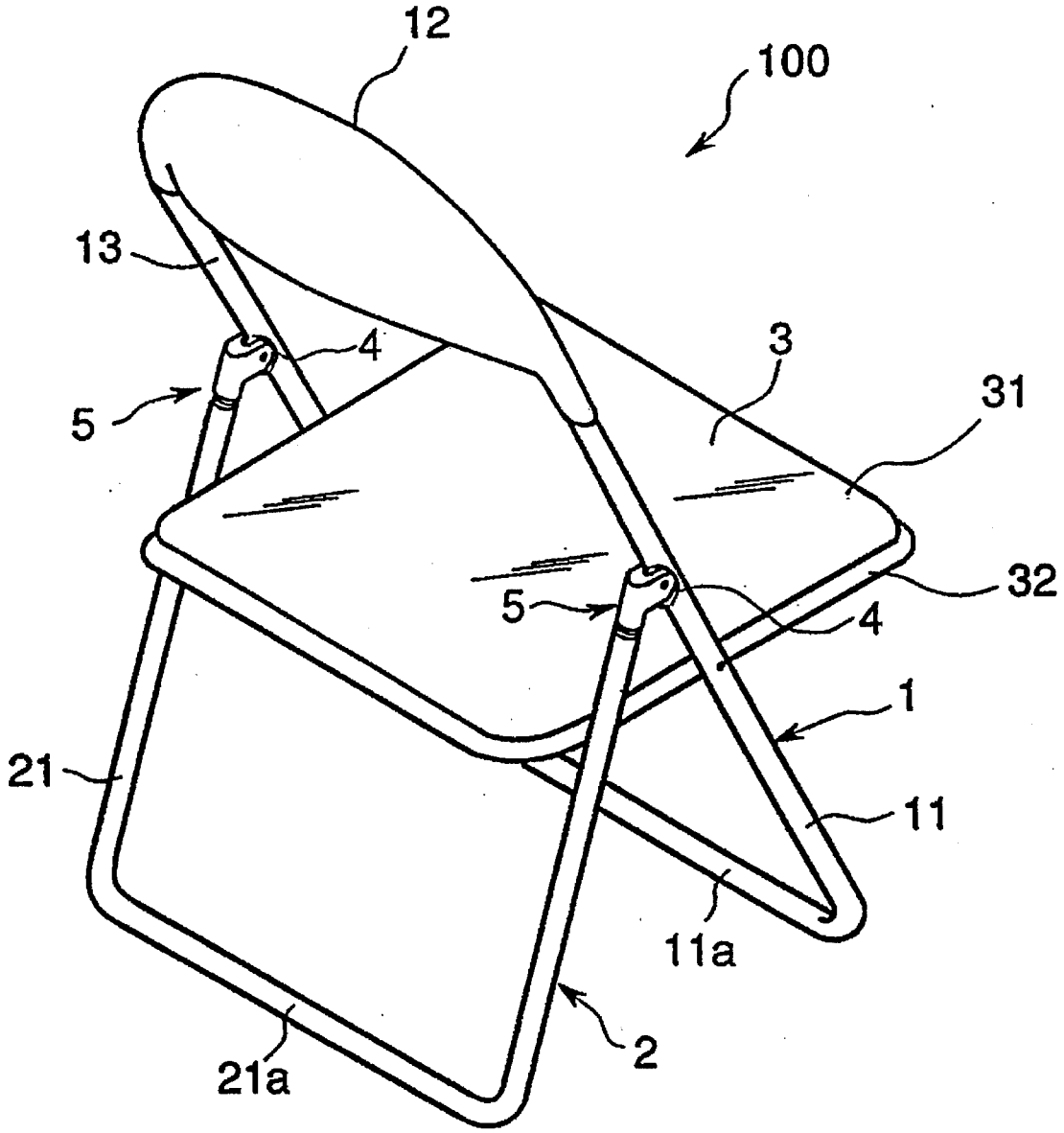
FIG. 1 is a perspective rear view showing a foldable chair in accordance with a preferred embodiment of this invention.
Figure 2:
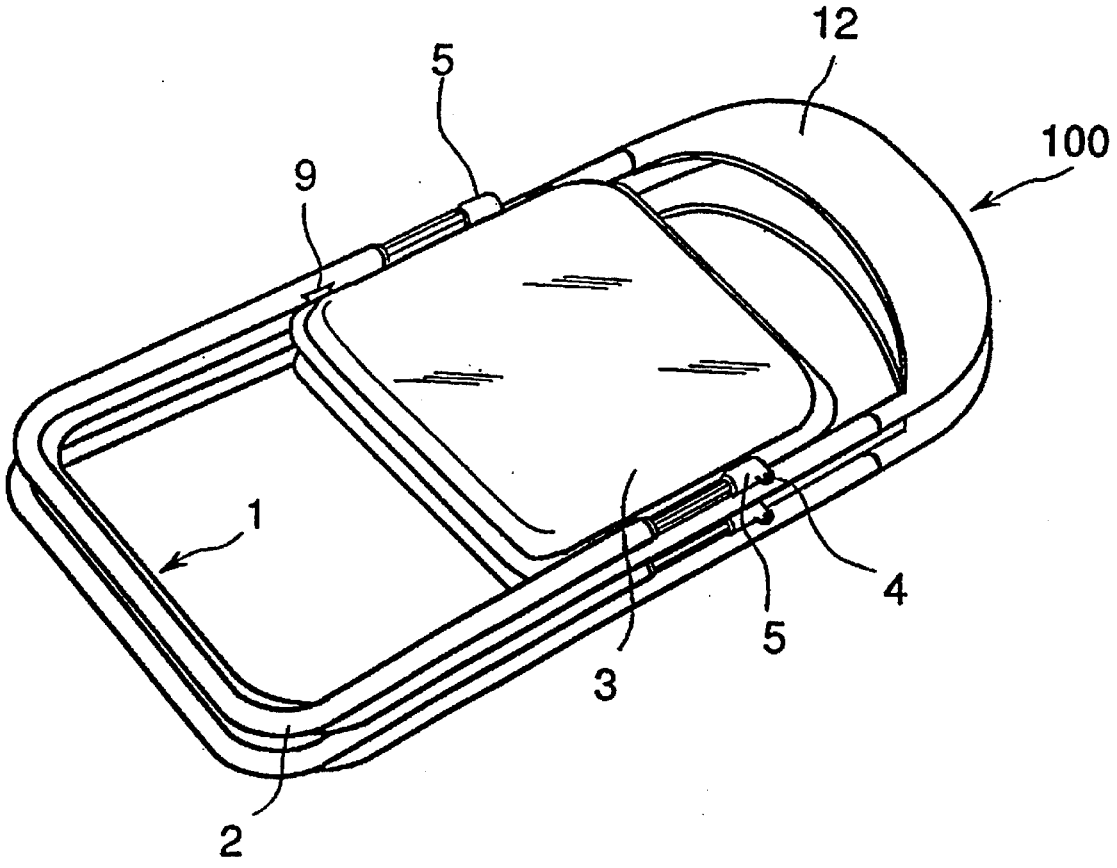
FIG. 2 is a perspective view showing the foldable chair of the preferred embodiment in a folded and stacked position.
Figure 3:
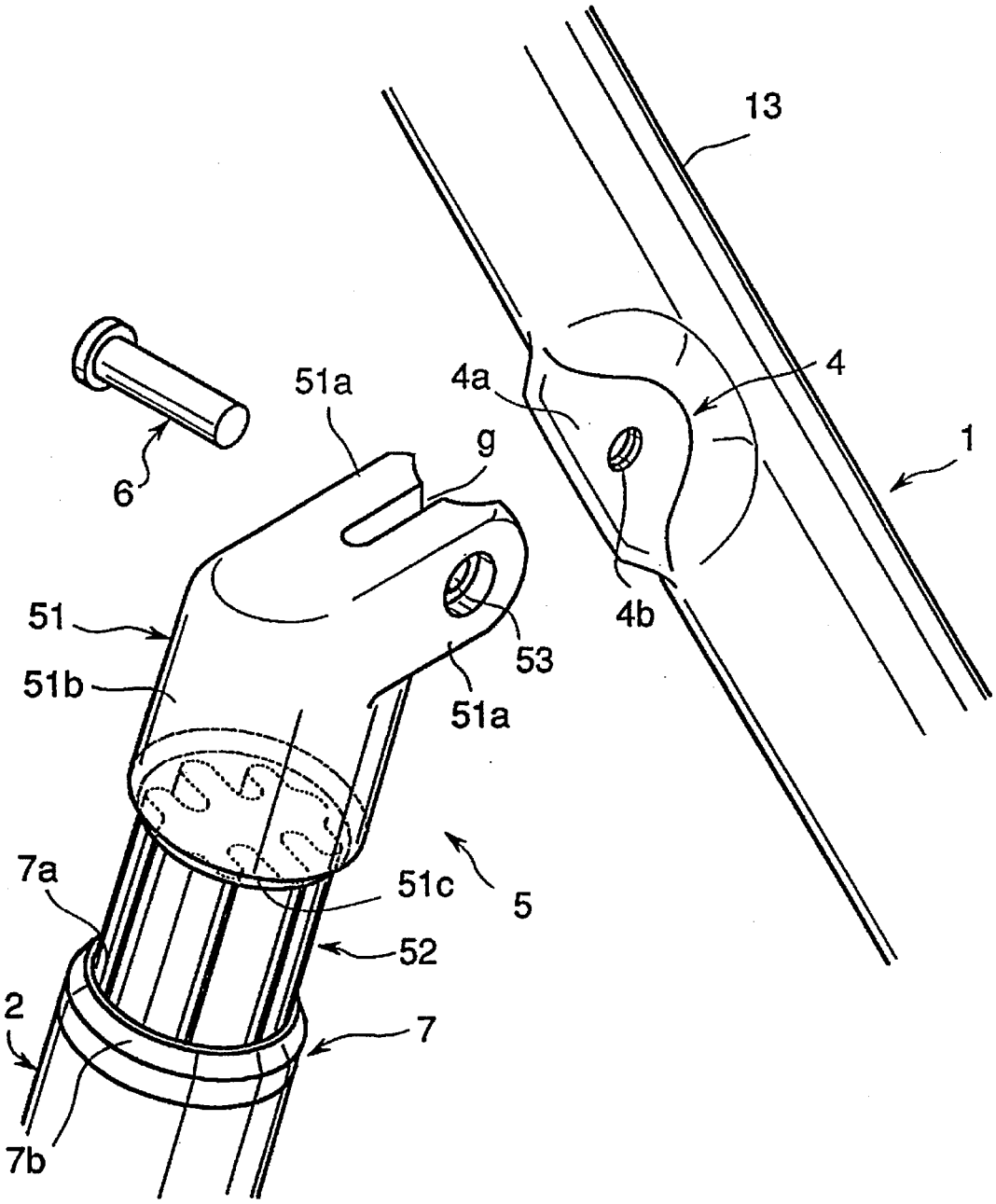
FIG. 3 is an enlarged exploded perspective view showing the principal portion of the mechanism in accordance with the preferred embodiment.
Figure 4:
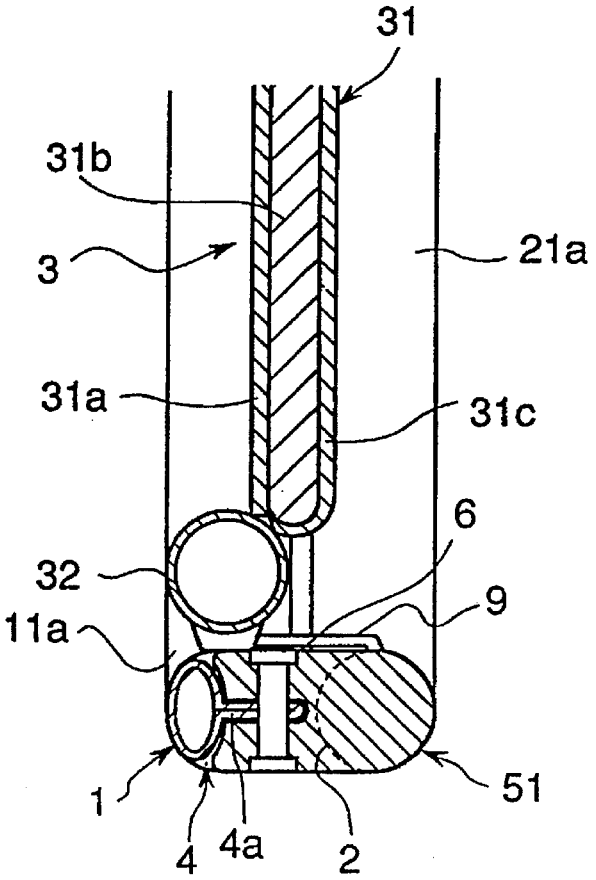
FIG. 4 is a transverse sectional view showing the principal portion of the mechanism in a folded position.
Figure 5:
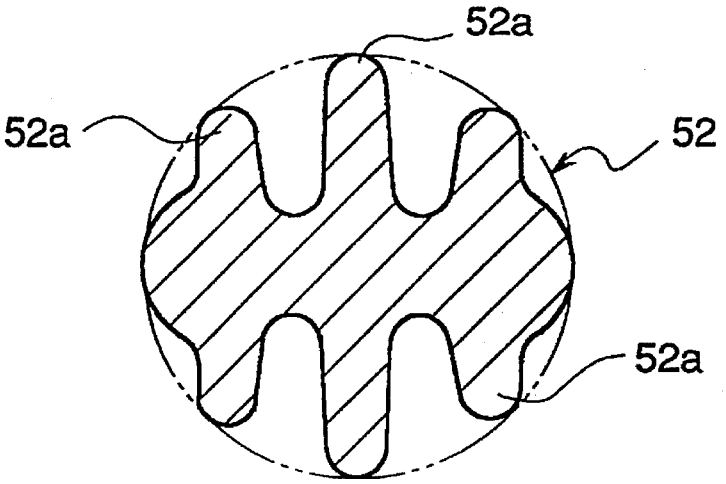
FIG. 5 is a sectional view showing the sliding shaft of the preferred embodiment.

FIG. 1 is a perspective rear view of a foldable chair in accordance with a preferred embodiment of this invention shown when in use. FIG. 2 is a perspective view of the foldable chairs of FIG. 1 folded and stacked in stock. FIG. 3 is an enlarged exploded perspective view of the principal portion of the mechanism of the foldable chair shown in FIG. 1. FIG. 4 is a transverse sectional view of the principal portion of the mechanism of the foldable chair shown folded. FIG. 5 is a sectional view of the sliding shaft constituting the principal portion of the mechanism.

The foldable chair 100, as shown in FIG. 1, comprises a front frame 1 having a pair of front legs 11 and a backrest 12 integral therewith, a rear frame 2 having a pair of rear legs 21 each with a slide link 5 as a sliding shaft on the top end thereof, and a seat 3. The chair is so arranged that it can be folded into a generally flat configuration with the front frame 1, the rear frame 2 and the seat 3 overlapped (as shown in FIG. 2). The front frame 1 and the rear frame 2 are made of steel pipe having the same outer diameter. The lower portions of the frames 1,2 are bent into a generally U-shape with lower crossbars 11*a* and 21*a* arranged parallel to each other and placed on the floor. The seat 3 comprises a seat body 31 having a seat board 31*a*, a cushion material 31*b* on the seat bard 31*a* and a covering material 31*c* over the cushion material 31*b*, and a seat frame 32 made of steel pipe which surrounds the seat body 31 and supports the seat board 31*a*. The arrangements of the seat 3 and the backrest 12 may be the same as well known in the art.

The front frame 1 including the lower crossbar 11*a* is made of steel pipe bent into a generally U-shape and pivotally supports the sides of the seat frame 32 which constitute the sides of the seat 3. The backrest 12 is fixed to the top crossbar of the front frame 1, with a cushion material attached to the backrest 12 at the side of the seat 3 and across the opposite top ends of the front frame 1. The portions below the seat 3 of the front frame 1 will be referred to as the front legs 11 and the portions thereof above the seat 3, as the back support rods 13. Namely, the front legs 11 are those portions of the frame 1 of steel pipe to the top end of which the backrest 12 is fixed, which extend below the seat 3, including the lower crossbar 11*a*. A pair of concaves 4 are formed in the front frame 1 a short distance above the seat 3. A slide link 5 extends upwardly from the upper end of each of the rear legs 21 of the frame 2 has a pivot member 51 pivotally joined to the concave 4.

Each concave 4 is formed, as shown in FIG. 3, by pressing a rear half of the front frame 1 facing the rear frame 2 from both sides for plastic deformation. In other words, in the preferred embodiment, the concave 4, which is recessed in the surface of the pipe of the front frame 1, is formed by applying a pressure to both sides of the pipe, thereby to deform the portions of the pipe, whereupon a plate-like part 4*a* whose thickness is approximately twice that of the material constituting the front frame 1 is formed in the middle of the concave 4, that is, the inner surfaces of the front frame 1 contact each other at the plate-like part 4*a*. The plate-like part 4*a* is located at the rear side of the axis of the front frame 1. A through hole 4*b* is formed parallel to the lower crossbar 11*a* in the plate-like part 4*a* of the concave 4 and the pivot member 51 is pivotally joined to the plate-like part 4*a* by a pivot pin 6.

The slide link 5 which is pivotally joined to each concave 4 is slidably mounted to each top end of the rear frame 2. The rear frame 2 is pivotally mounted near the top end thereof to each of the opposite sides of the seat frame 32 by a fixing member 9. The rear frame 2 is so arranged as to overlap the front leg 11 when folded. Each slide link 5 mounted to the rear frame 2 is of synthetic resin and comprises a shaft 52 which is inserted into the rear frame 2 and a pivot member 51 integrally formed at the top end of the shaft 52. In order to diminish frictional resistance, each shaft 52 has such a configuration that a plurality of ribs 52*a* are integrally formed, as shown in the section of FIG. 5. The shaft 52 is contained in the rear frame 2 when in use and extends from inside the rear frame 2 as the rear frame 2 moves when the foldable chair 100 is folded. In order to support each shaft 52 slidably and movably at the top end of the rear frame 2, a cap member 7 is fixed to the top end of the rear frame 2. A through hole 7*a* through which the shaft 52 passes is provided in the center of each cap member 7. The cap member 7 not only prevents a cut end of the rear frame 2 from touching the pivot member 51 directly but also effectively prevents the pivot member 51 and the shaft 52 from being damaged by burr which is made inside the cut end of the rear frame 2 when the pipe material of the rear frame 2 is cut. The circumference 7*b* of the upper surface of each cap member 7 is chamfered considerably and the circumference 51*c* of the lower surface of each pivot member 51 facing the cap member 7 is also chamfered considerably (shown in FIG. 3) Each pivot member 51 has a bifurcated pivot part 51*a* at its top and a cylindrical base part 51*b* which is integrally formed with the upper end of each shaft 52. The pivot part 51*a* has a gap a corresponding to the thickness of the plate-like part 4*a* of the concaves 4. The pivot part 51*a* is nearly equal in width to the outer diameter of the front frame 1, and has a pivot hole 53 through which the pivot pin 6 passes horizontally.

In the arrangement of the preferred embodiment, each slide link 5 is mounted to the rear frame 2 by fixing the cap member 7 to the top end of the rear leg 21 and passing the shaft 52 of the slide link 5 through the through hole 7*a* of the cap member 7. Then the seat 3 is pivotally supported by the front frame 1 and the rear frame 2, and the pivot member 51 of the slide link 5 is positioned at the concave 4 of each support rod 13 of the front frame 1. Next, the pivot hole 53 of the pivot member 51 and the through hole **4*b* in the plate-like part 4*a* of the concave 4 are brought into coincidence with each other, and the pivot pin 6 is passed through the pivot hole 53 and the through hole 4*b*. Then the forward end of the pivot pin 6 is riveted, thereby to prevent the pivot pin 6** from being pulled away.

For mounting the slide links 5 pivotally to the front frame 1, the concaves 4 are formed by pressing predetermined portions of the support rods 13 of the front frame 1 and the pivot members 51 of the slide links 5 are pivotally joined to the concaves 4, so that there is no need to provide additional members for the pivotal connection. In other words, as it is not necessary to weld a plate, for example, a semicircular plate to a required position corresponding to the pivot part **51*a* of the pivot member 51, it becomes easy to form the pivot device. In addition, there is no need to transfer the pipe being machined from the cutting or bending line onto the welding line, so that the manufacturing line is simplified. The shaft 52 and the pivot member 51 which constitute the slide link 5 are integrally formed of synthetic resin, thereby to reduce the number of component parts and render the manufacturing cost lower. The shaft 52 is not a cylinder in shape having generally the same outer diameter as the inner diameter of the through hole 7*a* of the cap member 7 but has on its outer circumferential surface a plurality of ribs 52*a* so that the shaft 52 contacts the cap material 7 on a small area and moves smoothly. Therefore the foldable chair 100** can be folded or set for use easily.

In addition, as the pivot member 51 is pivotally mounted to the plate-like parts **4*a* of the concave 4 located at the rear side of the front frame 1, the rear frame 2 is not located at the lateral sides of the front frame 1. Namely, the pivot member 51 is, as shown in FIG. 4, pivotally mounted to the rear surface of the front frame 1, the axis of the rear frame 2 generally overlaps the axis of the front frame 1 as viewed from the front or rear side. Therefore the distance between the rear frame 2 and the seat frame 32 of the seat 3 can be minimized, thereby to increase the strength of the points at which the seat 3 is mounted to the rear frame 2. The width of the foldable chair 100 is equal to that of the front frame 1 when in use so that the width of the foldable chair 100 can be smaller than that of a chair in which the rear frame 2 is pivotally joined to the lateral sides of the front frame 1, thereby to improve space efficiency. Further, when folded, the rear frame 2 generally overlaps the front frame 1, so that the foldable chair 100 is smaller in width than the chair in which the rear frame is pivotally joined to the lateral sides of the front frame 1. In other words, if the foldable chair 100 is placed, for example, on the floor with the front frame 1 underlying, the rear frame 1 is placed right above the front frame 2, thereby to enable the foldable chairs 100 to be stacked within the width of the front frame 1. Therefore, as compared to a chair in which the rear frame 2 is located at the lateral sides of the front frame 1, the foldable chairs 100 occupy a smaller space when stacked one upon another and placed side by side, so that the number of the foldable chairs 100** which can be stacked increases, thereby to improve space efficiency when they are stored in stacks.

Figure 6:
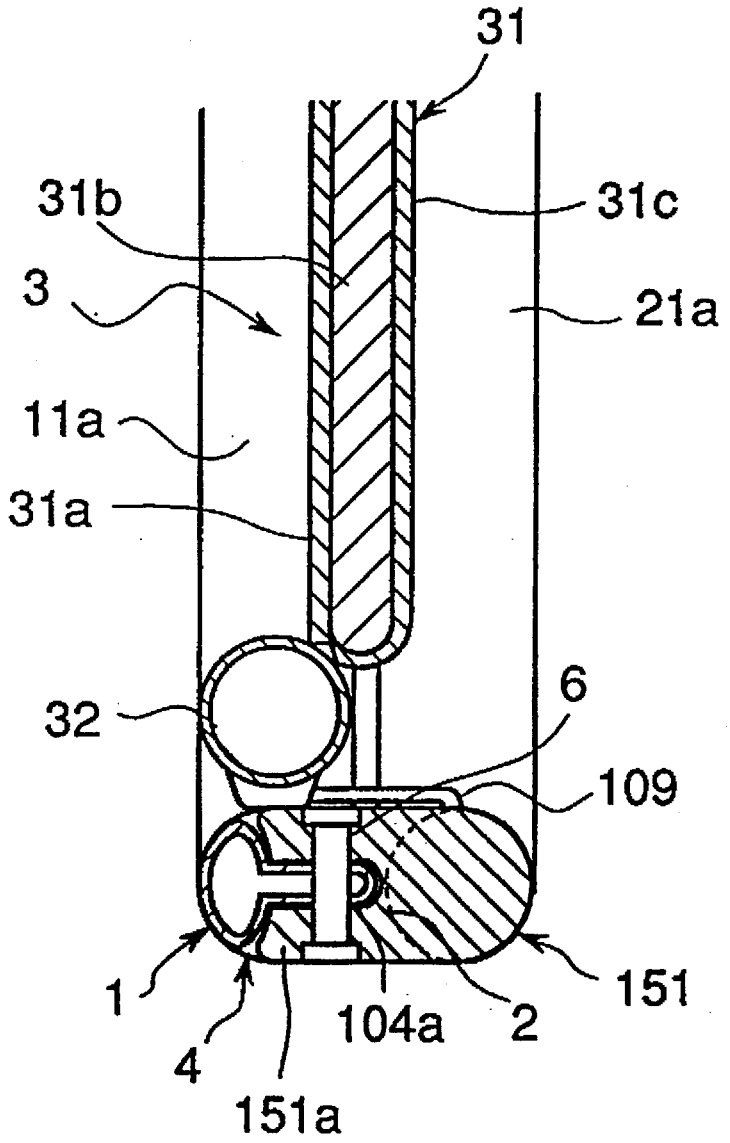
FIG. 6 is a transverse sectional view similar to FIG. 4 and showing a modification of the preferred embodiment.

The concave 4, as shown in FIG. 6, may include a plate-like part **104*a* formed by pressing a portion of the front frame 1 with a little space left between the opposing inner surfaces, although in the above-described embodiment the plate-like part 4*a* is formed by pressing a portion of the front frame 1 so that the opposing inner surfaces of the material constituting the front frame 1 contact each other. In this case, the total thickness of the plate-like part 104*a* and the pivot portion 151*a* of the pivot member 151 is set generally equal to the outer diameter of the front frame 1 by adjusting the thickness of the plate-like part 104*a* and that of the pivot portion 151*a*. In accordance with the arrangement, as the plate-like part 104*a* has an increased thickness with its sectional area being not very small as compared to the sectional area of the remaining part of the front frame 1, thereby to prevent the strength of the plate-like part 104*a* from decreasing. Moreover, like the above-mentioned embodiment, as the slide link 5 is positioned rearward of the axis of the front frame 1, the rear frame 2 neither projects from the lateral sides of the front frame 1 nor has any members which project laterally. Therefore, the points at which the seat 3 is supported can be strengthened, space efficiency can be improved when in use, and the area for storage can be reduced. The numeral 109 in FIG. 6 indicates a fixing member by which the seat 3 is mounted to the rear frame 2**.

Figure 7:
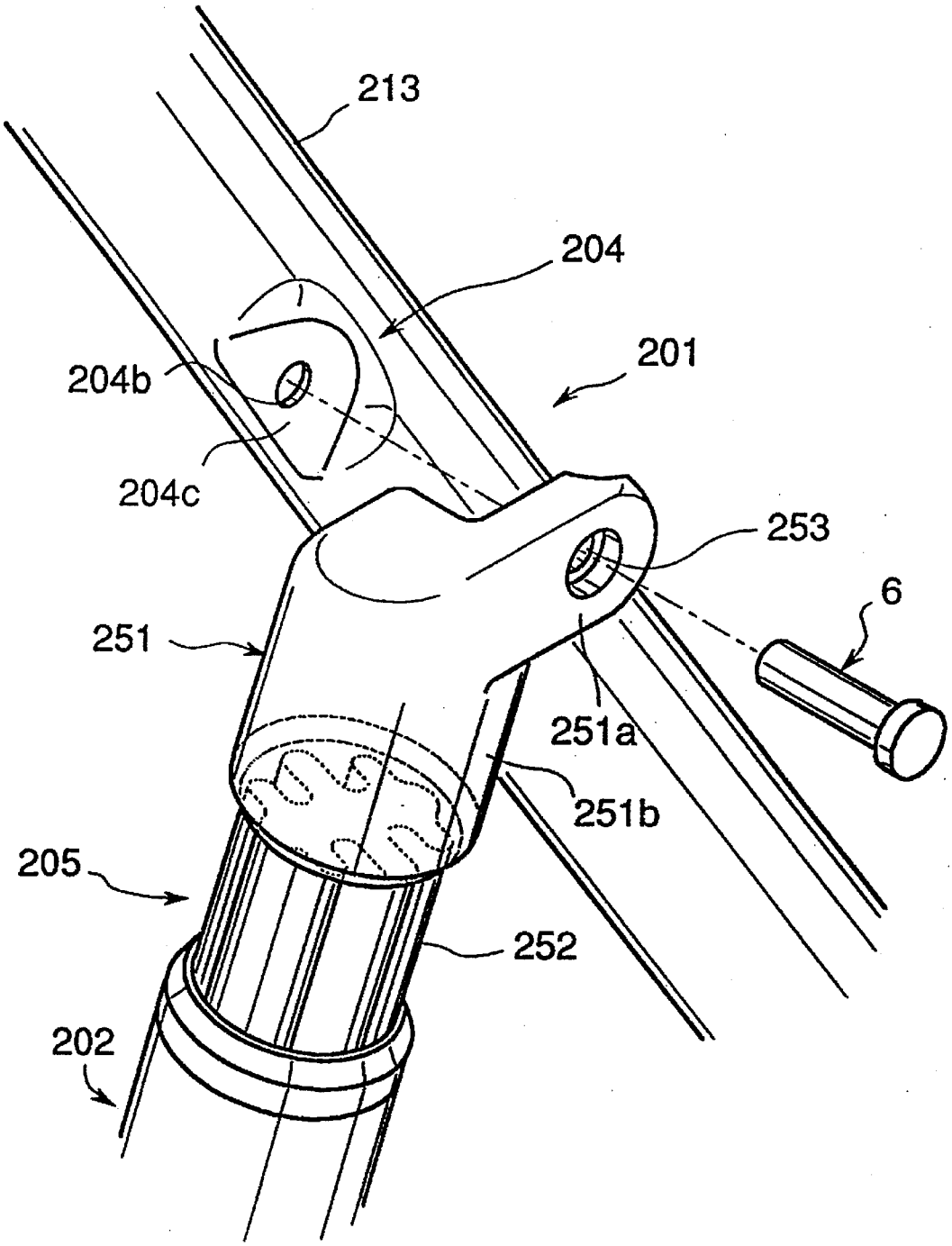
FIG. 7 is an exploded perspective view similar to FIG. 3 and showing another preferred embodiment of the invention.
Figure 8:
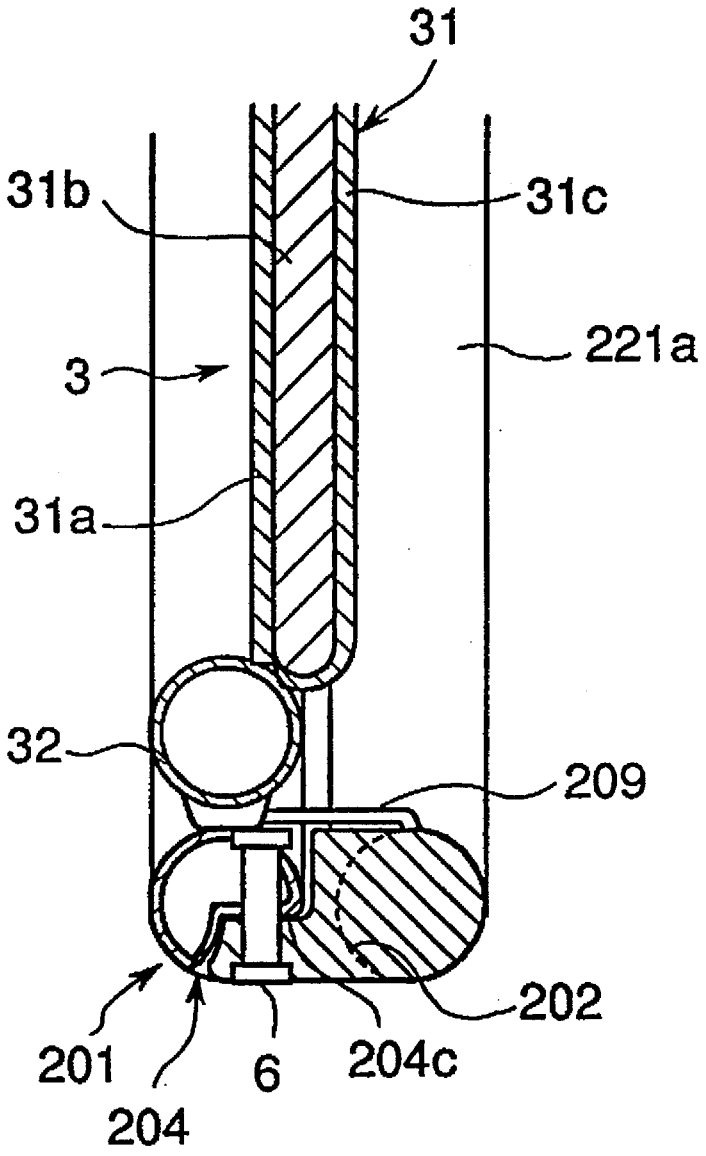
FIG. 8 is a transverse sectional view similar to FIG. 4 and showing the another preferred embodiment of the invention.

FIG. 7 and 8 show another preferred embodiment of the invention.

This embodiment is different from the embodiment previously described in the shape of the concave 204 and the shape of the pivot member 251 of the slide link 205. In this embodiment, the front frame 201 and the rear frame 202 are essentially the same as those of the above embodiment. The connection between the front frame 201 and the seat 3 and the connection between the rear frame 202 and the seat 3 by a fixing member 209 are the same as those of the above-mentioned embodiment. Therefore, no description will be given about the arrangements of the front frame 201 and the rear frame 202.

Unlike in the above embodiment, the concave 204 is formed by transforming only the outer side of the rear half of the front frame 201. The concave 204 is provided at a portion near to the lower end of each back support rod 213 which is located above the seat 3 in the front frame 201. In other words, the inner side of the front frame 201, namely, the side thereof facing the seat 3 retains the tubular shape of the pipe of the front frame 201 without being pressed while the outer lateral side thereof is collapsed to form the concave 204. The concave 204 is provided with a planar side **204*c* facing outside. In the planar side 204*c* a through hole 204*b* is formed parallel to the lower crossbar 221*a* and passes also through the inner side of the front frame 201**.

On the other hand, the pivot member 251 of the slide link 205 is integrally formed with the shaft 252 as in the above embodiment and the base portion **251*b* of the pivot member 251 is the same in shape as that of the above embodiment. The pivot portion 251*a* of the slide link 205 is in the shape of a plate having an elongated generally semicircular configuration and provided at the upper end of the base portion 251*b*. Namely, the pivot portion 251*a* is provided at a position displaced laterally outward of the axis of the shaft 252 and corresponding to the concave 204, thereby to cause the axis of the shaft 252, namely the axis of the rear frame 202, and the axis of the front frame 201** to overlap generally as viewed from the front or rear side.

The slide link 205 is mounted pivotally by first bringing the pivot hole 253 of the pivot portion **251*a* into coincidence with the through hole 204*b* of the concave 204, then inserting the pivot pin 6 into the pivot hole 253 and the through hole 204*b*, and finally riveting the end of the pivot pin 6 inserted therethrough. As the slide link 205 is pivotally mounted at its top end to the concave 204 which is formed at the outer side of the front frame 201, it becomes easy to insert and rivet the pivot pin. In addition, the decrease of the sectional area at the portion where the concave 204 is formed is kept about one-fourth of that of the front frame 1, thereby to prevent the strength of the concave 204 from being diminished. Moreover, the shaft 252 and the pivot member 251 of the slide link 205 are integrally formed of synthetic resin, thereby to diminish the number of component parts. Further, as the pivot portion 251***a* of the pivot member 25 is formed of a single plate-like configuration, the structure of the mold for the pivot member 251 can be simplified, thereby to lower the manufacturing cost.

The invention is not limited to the above-mentioned embodiments. For example, in each of the above-mentioned embodiments, the slide link 5, 205 is comprised of the shaft 52, 252 and the pivot member 51, 251 integrally formed of synthetic resin, but may be comprised of a shaft and a pivot member as separate members. Namely, for example, a shaft may be of metal and a pivot member may be of synthetic resin, or both of them may be of metal. In the above embodiments, the shaft 52 is an aggregation of the ribs 52*a*, but may be a round pipe or a round rod. In this case, the outer surface of the shaft is preferably covered with resin having a small coefficient of friction so as to diminish the friction between the shaft and the cap member 7.

The front frame 1 may be made of a single piece of steel pipe bent into a loop, both ends of which are brought into end-to-end contact with each other and connected by welding. Namely, the frame is not open at its upper end, but continuously arched at the part to which the backrest is mounted. In this case, the backrest is preferably mounted to the arched portion.

The component parts are not limited to those illustrated, but there may be various modifications without departing from the spirit or essential characteristics thereof.

POSSIBILITY OF USE IN INDUSTRY

The foldable chairs in accordance with the invention are suitable for arrangement in many lines or rows on the floor in halls of every kind or gymnasiums, and easy to set for extra use when necessity requires to increase the number of seats in haste.

We claim:

1. A foldable chair comprising:

a front frame made of plastically transformable pipe material with a backrest provided at its top end and having a pair of front legs continuously extending downward from said top end, said frame pipe material having a rear half and first and second sides;

a rear frame made of pipe material having a pair of rear legs continuously extending downward from its top end and a pair of sliding shafts whose top ends are each pivotally mounted to said from front and whose bottom ends are each slidably inserted into the top end of a respective one of the rear legs; and a seat having its lateral sides pivotally supported near its rear side by the rear frame and by the front frame forwardly of the position supported by the rear frame;

said chair being characterized by; the front frame being provided with concaves formed therein above the front frame seat pivots, each of said concaves being formed so as to occupy both sides of the front frame pipe material and including said rear half of said front frame material formed as a generally flat portion; the sliding shafts being provided at their upper ends with pivot members mounted to said flat portions; and the front and rear frames being so arranged that an axis of each of the rear legs is generally aligned with that of the corresponding front leg as viewed from the direction in which the foldable chair is folded, and when the chair is folded, the front side of the rear frame substantially contacts the rear side of the front frame.

2. The foldable chair according to claim 1 wherein said rear half of the front frame is formed into said generally flat portion by compression.

3. The foldable chair according to claim 1 wherein each of said pivot members has an elongated plate having a generally semi-circular configuration for rotating relative to a respective one of said concaves.

* * * * *